US005213302A

United States Patent [19]

Rowe, Jr.

[11] Patent Number: 5,213,302

[45] Date of Patent: May 25, 1993

[54] SUPPORT FOR COMPUTER KEYBOARD ON TOP OF DISPLAY SCREEN DEVICE

[75] Inventor: Frederick D. Rowe, Jr., Atlanta, Ga.

[73] Assignee: Additional Ideas, Inc., Atlanta, Ga.

[21] Appl. No.: 745,985

[22] Filed: Aug. 8, 1991

Related U.S. Application Data

[63] Continuation-in-part of Ser. No. 553,235, Jul. 16, 1990, abandoned.

[51] Int. Cl.[5] ..... A45D 19/04

[52] U.S. Cl. ..... 248/918; 248/459; 248/152; 248/441.1

[58] Field of Search ..... 248/918, 205.2, 441.1, 248/453, 146, 152, 447.2, 442.2, 445, 459, 174

[56] References Cited

U.S. PATENT DOCUMENTS

| | | | |
|---|---|---|---|
| 1,169,869 | 2/1916 | Richards | 248/453 |
| 3,599,925 | 8/1971 | Dubler | 248/452 |
| 3,809,352 | 5/1974 | Mathias | 248/451 X |
| 3,889,914 | 6/1975 | Torme | 248/445 |
| 4,073,460 | 2/1978 | Dale | 248/441.1 X |
| 4,511,111 | 4/1985 | Godfrey et al. | 248/918 X |
| 4,834,330 | 5/1989 | Swillinger | 248/918 X |
| 5,042,761 | 8/1991 | McBride et al. | 248/918 X |

*Primary Examiner*—Alvin C. Chin-Shue

*Attorney, Agent, or Firm*—Watson, Cole, Grindle & Watson

[57] ABSTRACT

A support system for supporting a keyboard on top of a display screen device comprises a rigid sheet material which has been bent to form two holding surfaces for the keyboard. The surfaces are separated by an angle. A retaining lip for each holding surface which prevents a keyboard from slipping off the holding surface is also provided. Various accessories may be provided, which are easily attached to the support system. The support system is especially well suited for supporting a keyboard on top of non-planar, non-horizontal and offset surfaces.

19 Claims, 6 Drawing Sheets

Fig. 5.
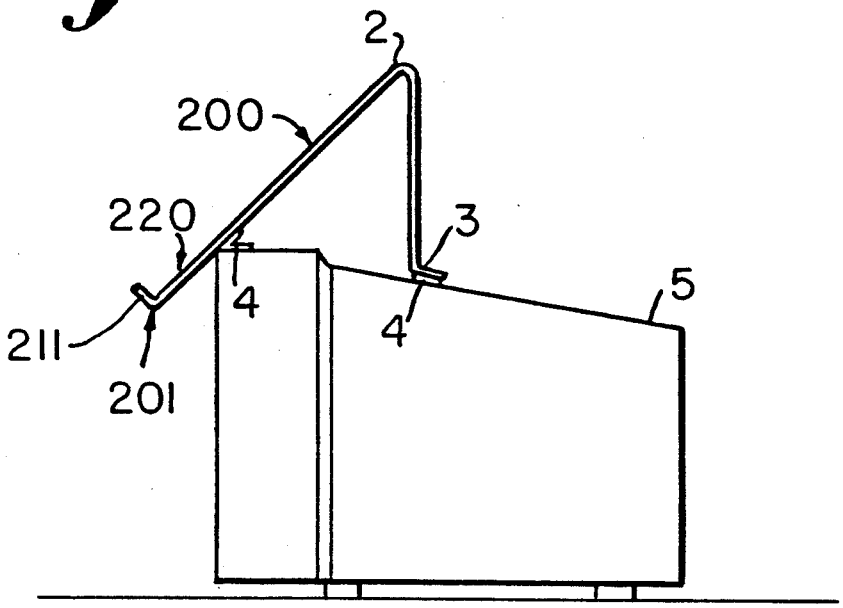
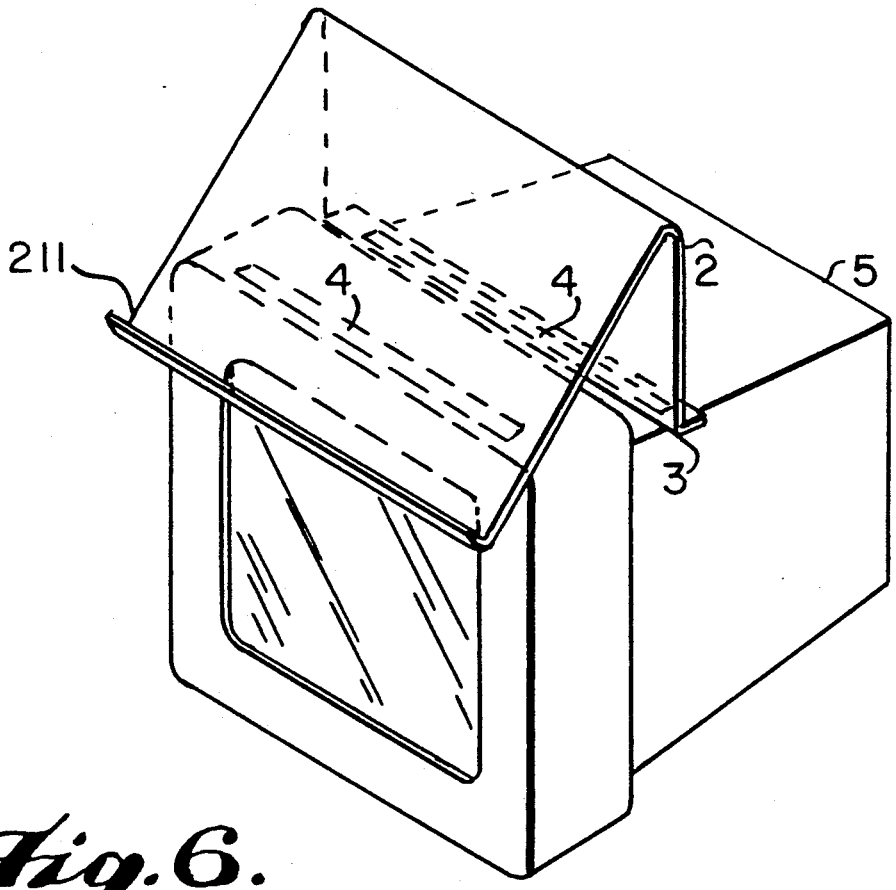
Fig. 6.

Fig. 9.
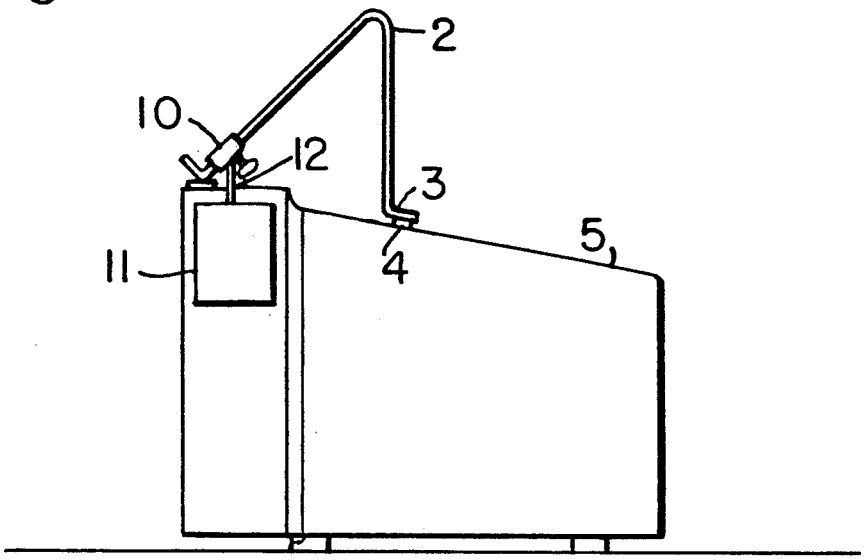
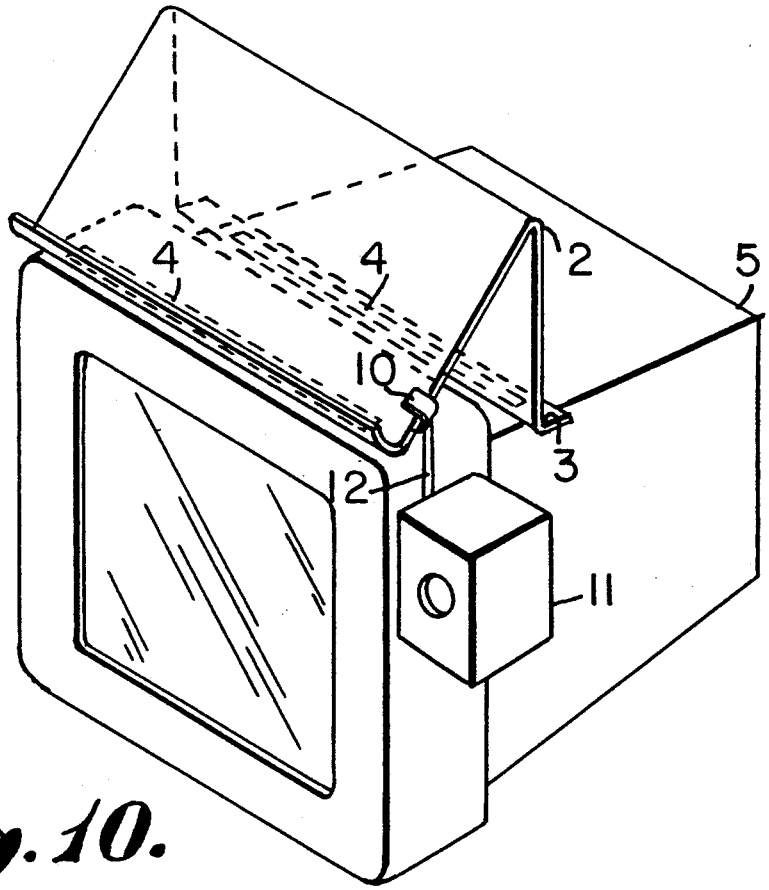
Fig. 10.

SUPPORT FOR COMPUTER KEYBOARD ON TOP OF DISPLAY SCREEN DEVICE

This application is a continuation-in-part of Ser. No. 07/553,235, filed Jul. 16, 1990, abandoned.

FIELD OF THE INVENTION

The present invention relates to computer keyboard supports, and more particularly to a support which can be mounted to a computer monitor.

BACKGROUND OF THE INVENTION

It is frequently desirable to remove a computer keyboard from a work space in such a way that the work space can be used for other materials. It is also desirable to retain access to the keyboard in its removed location.

A number of devices have been proposed for this purpose. These devices include sliding drawers, where the keyboard is slid under a shelf typically under the central processing unit. These drawers have suffered from shortcomings which include a lack of access in its retracted location, large desk space requirements, and obstructions encountered during drawer operation. Other devices use pivot arms, parallelogram type linkages, and/or complicated arrangements for supporting a work station platform. These devices suffer from interference with the operator or other items in the work space, difficult installation, lack of access to the keyboard in its retracted location, and expensive cost and maintenance.

All these prior art devices suffer from one or more drawbacks. The devices are overly complicated, expensive, require large desk space, prevent access to the keyboard in its removed position, are difficult to install, or interfere with the operator or other items in the work space.

Therefore, it is a primary object of the present invention to provide a new and improved support device for computer keyboards which overcomes the above-mentioned problems.

A further object of the present invention is to provide a new and improved computer keyboard support which is simple to operate, accessible, uses little desk space, is easy to install, has adequate strength, does not interfere with the operator or other items in the work space, and is economical in construction and maintenance.

SUMMARY OF THE INVENTION

The foregoing objects are achieved according to the present invention through the provision of a support which is to be mounted on a display screen device in such a way that a keyboard may be held securely enough for safe operation and storage on top of the display screen device. More specifically, the support is attached to the display screen device by adhesive strips of hook and loop material at the front bottom and back bottom of the support, with the mates of the adhesive strips of hook and loop material at the front top and middle top, respectively, of the display screen device. The support has an angle to the holding surface so that the keyboard can be viewed while on the support. At the front of the support, there is a lip which prevents the moment of the keyboard down the incline of the holding surface. There is also a lip of the back of the support so that the support can be turned around to provide a holding surface with a different angle.

Alternatively, the support may be mounted using straps, cords, glue, or tape. Also, a further embodiment allows for a variable holding surface angle in relation to the display screen device. Additionally, a further embodiment provides for an extension of the support material at the front of the display screen device so that the display screen is shielded from ambient light. Another embodiment allows for the adjustment of the screen shielding angle in relation to the display screen device.

BRIEF DESCRIPTION OF THE DRAWINGS

The preferred embodiment of the invention will now be more particularly described by way of example with reference to the accompanying drawings wherein:

FIG. 5 is a right side elevational view of another support according to the present invention wherein the support extends below the top front of the display screen device to double as a screen shield;

FIG. 6 is a perspective view of the support shown in FIG. 5;

FIG. 9 is a right side elevational view of a support according to the present invention having an accessory attached thereto;

FIG. 10 is a perspective view of the support and accessory shown in FIG. 9;

DESCRIPTION OF THE PREFERRED EMBODIMENTS

According to the present invention, a support for supporting a keyboard on top of a display device is provided which is simple, inexpensive, and easy to manufacture. The support can be manufactured from a substantially rectangular single sheet of bendable rigid sheet material by making three bends in the sheet. Attachment means to secure the support to the top of a display device can be provided at the front, back, or both the front and the back of the support. Any conventional attachment means may be employed for securing the support to the display device. Mating attachment means can be provided on both the support and the display device, such as hook and loop fasteners, buttons, etc.

The support comprises two primary holding surfaces, either of which may be used to support a keyboard. The holding surfaces are of differing lengths, so that differing holding angles are provided. The two primary holding surfaces may be connected by a hinge means so that an infinite number of holding angles for the keyboard may be attainable.

Each primary holding surface is of a width which preferably exceeds the width of the keyboard to be held. The holding surfaces are preferably as long or longer than the distance from the front of the keyboard to the back of the keyboard (keyboard length) so that a solid holding surface is provided.

A retaining lip is provided at the bottom of each holding surface to assure a stable support on which a keyboard can securely rest.

Figure 1:
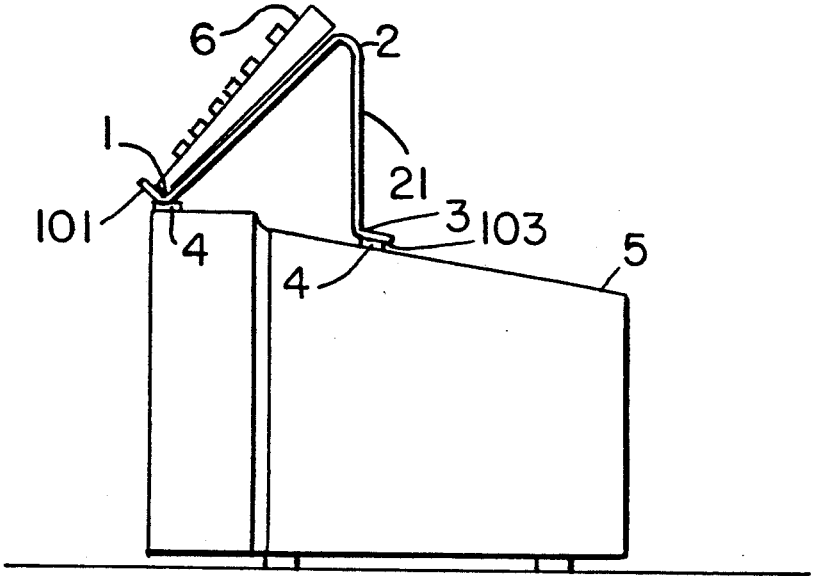
FIG. 1 is a right side elevational view of a support according to the present invention attached to a display screen device with a keyboard on top of the support.
Figure 2:
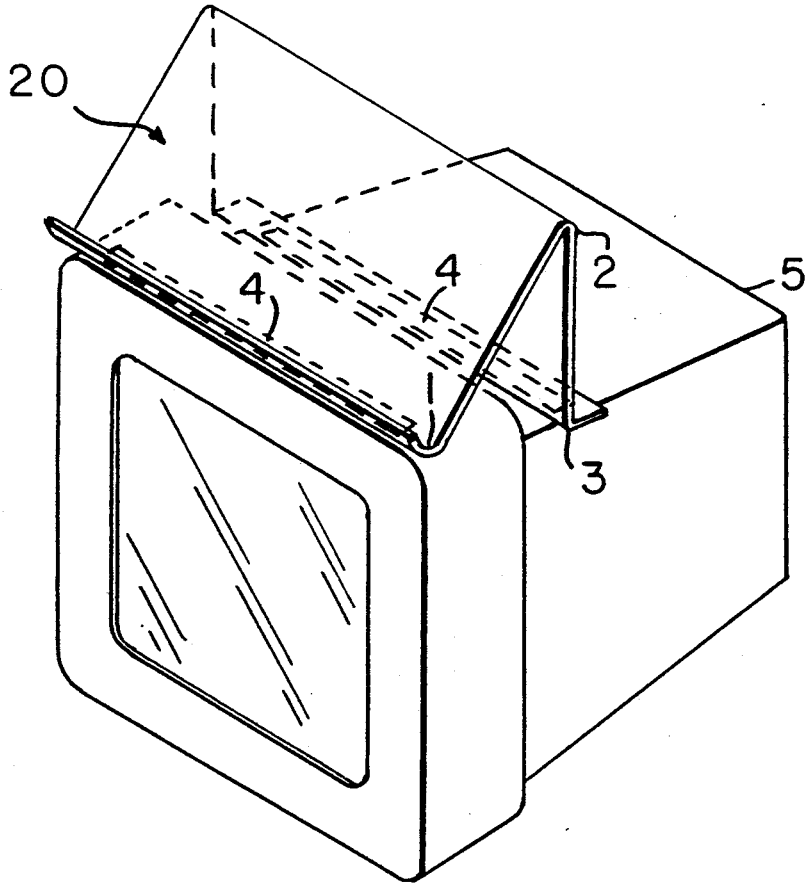
FIG. 2 is a perspective view of the support shown in FIG. 1.

As shown in FIGS. 1 and 2, the support is of a simple construction and can be manufactured from a single sheet of bendable rigid sheet material. Three bends are made in the sheet to form the support. The entire device can be as simple as the best sheet and two adhesive strips, one having hook-material and one having loop-material.

A primary retaining lip bend 1 is made in the sheet close to an end of the sheet, so that a primary retaining lip 101 is formed for a keyboard 6. The retaining lip preferably has a length of ½ to about 2 inches to provide a secure contact area of the keyboard within the lip while allowing easy access to the keyboard. On the outside of the angle formed by the primary retaining lip bend 1, attachment means are provided. If hook and loop fasteners 4 are used, an adhesive strip of one of the materials is provided on the support, while an adhesive strip of the other material is provided on the top front of the display device to which the support is to be attached.

A second bend 2 in the sheet is made a distance back from the primary retaining lip bend 1, which distance is greater than the width of the keyboard 6. After bend 2, the support slants back toward the rearward top of the display device 5. Bend 2 forms two primary holding surfaces, 20 and 21, for a keyboard. The lengths of the primary holding surfaces 20 and 21 are different from each other, so that by reversing the support, a different supporting angle for the keyboard can be attained.

A secondary retaining lip bend 3 is formed a distance from bend 2 which is also greater than the length of a standard keyboard to be supported. The outside of the secondary retaining lip bend 3 forms the attachment surface for a rear attachment means 4' if a rear attachment means is used. Mating attachment means may be provided on the display device adjacent where the rear attachment means 4' rests. The secondary retaining lip bend 3 also forms a secondary retaining lip 103 for the keyboard. The secondary retaining lip preferably has a length of between ½ and 2 inches.

Two strips of adhesive hook and loop material 4 and 4' may be used to form the front and rear attachment means of the support. The display device 5 has corresponding hook or loop fastening strips which mate with the front and rear attachment means. By turning the support around to change the angle of the holding surface, the secondary retaining lip bend 3 rests at the front top of the display device 5. The attachment means 4' then becomes the attachment means for the front top of the display device. Also, the primary retaining lip bend 1 then becomes the attachment means for the rear top of the display device.

Due to the two linear attachment surfaces of the support device, the support is especially suited for use on display devices and computer monitors which have non-planar and offset, non-horizontal surfaces. The angles are especially well suited for nesting keyboards in a secure fashion in a convenient location, while still permitting access to the keyboard.

In place of attachment means, rubber foot pads which are secured to the bottom of the support may also be used. If such pads are used, gravity holds the keyboard on the support and the support onto the display device.

In order to save even more space in a work station for a display device, various attachments can be made to the support to accommodate a variety of accessories. An example of these accessories is shown in FIGS. 3–12.

Figure 3:
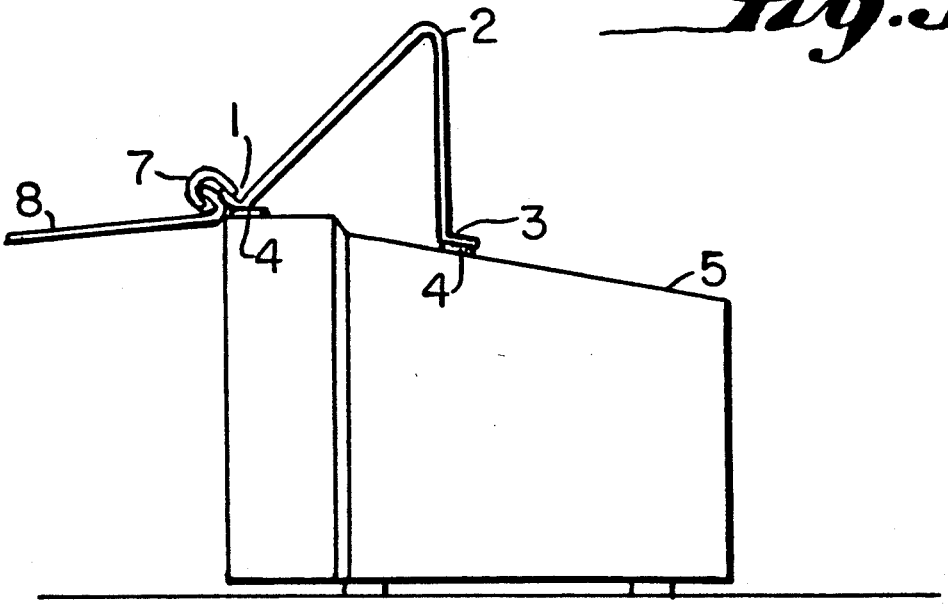
FIG. 3 is a right side elevational view of another support according to the present invention having a screen shield hingedly attached thereto.
Figure 4:
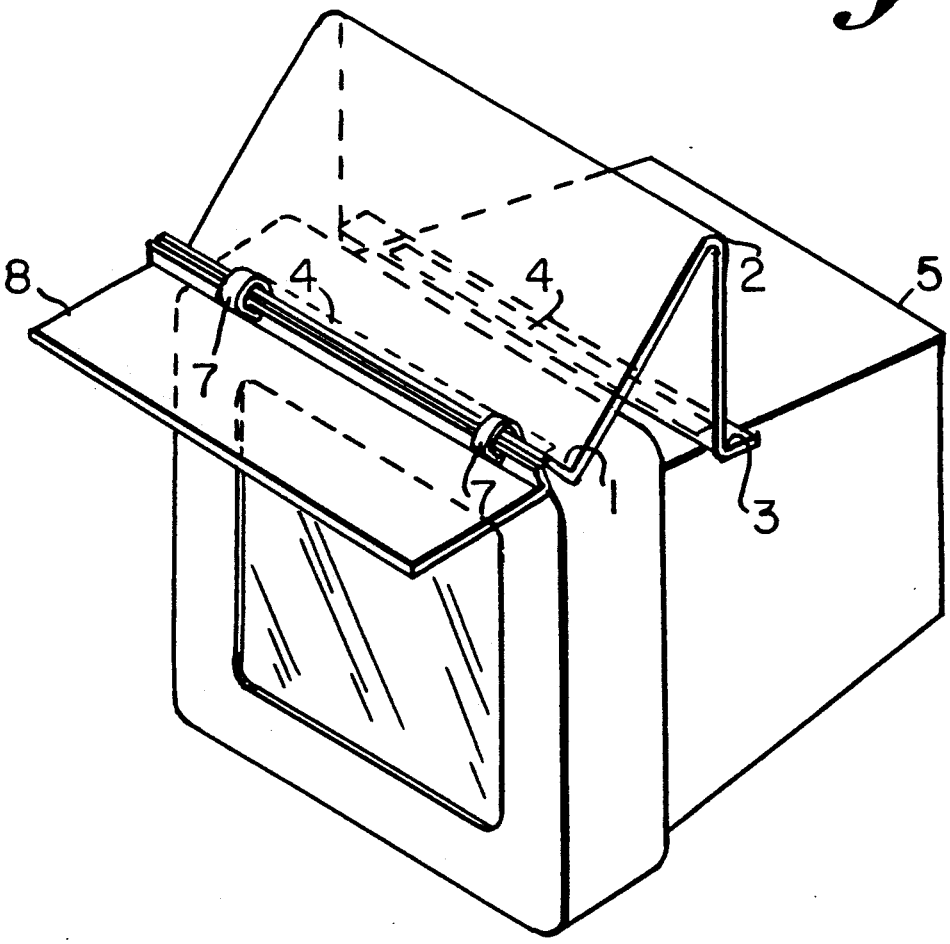
FIG. 4 is a perspective view of the support and shield shown in FIG. 3.
Figure 11:
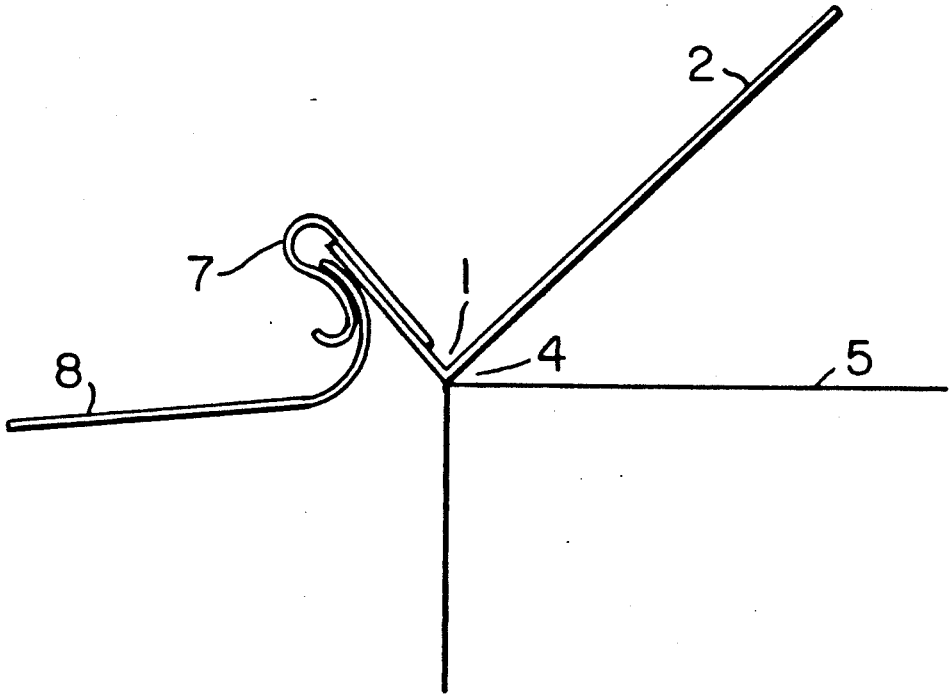
FIG. 11 is an enlarged detail of a preferred hinge mechanism for attaching a screen shield or glare screen to a support.

FIG. 3 shows a support similar to that shown in FIGS. 1 and 2, which has a screen shield 8 attached to it by hinge means 7. The hinge means 7 comprises an R-shaped metal clamp attachment which is best shown in FIG. 11. While a C-shaped clamp may be employed, the shaped clamp shown provides pivoting of an accessory, such as a visor, to an infinite number of angles. Herein, this will be referred to as an R-shaped clamp. The opening of the R-shaped clamp preferably narrows to a width which is less than the thickness of the retaining lip 101 and a curved upper lip of the accessory, combined. The screen shield 8 or "visor" can be made of the same rigid sheet material as the support. The accessory has a curved upper lip which has a smoothly curved C-shape which is gripped by the metal clamp 7 and held to the lip 101 of the support. The metal clamp 7 securely holds the visor 8 to the support in a fashion which allows the visor to be held at an infinite number of angles with respect to the support. The visor is the same width as the support, or at least as wide as the display screen surface. The visor's length should be sufficient to block ambient light from reflecting off of the display screen in a manner which disturbs the vision of an operator.

FIGS. 5 and 6 show another embodiment of the present invention, wherein the lip 211 from angle 201 extends beyond the front top surface of the display device. Thus, the support itself acts as a visor to block ambient light from the display screen. In this embodiment, the portion 220 of the primary holding surface 200 which extends beyond the front top of the display device is only about half the length of the keyboard (from front to back).

Figure 7:
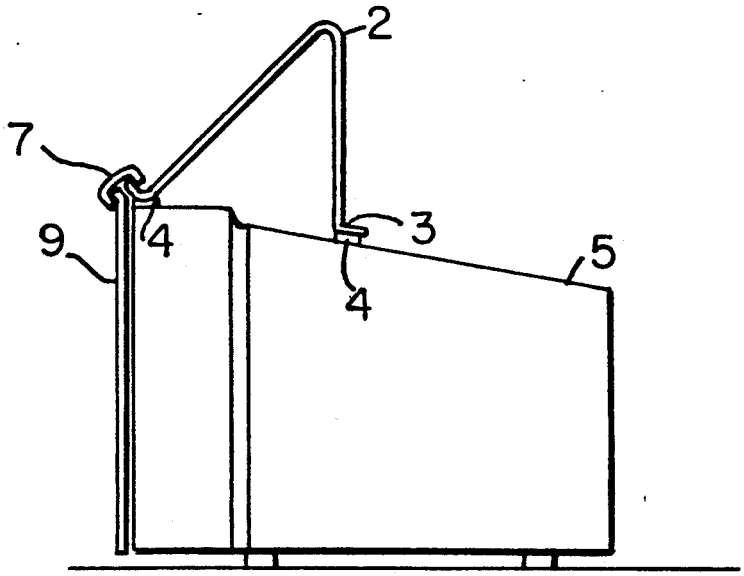
FIG. 7 is a right side elevational view of a support according to the present invention having a glare screen hingedly attached thereto.
Figure 8:
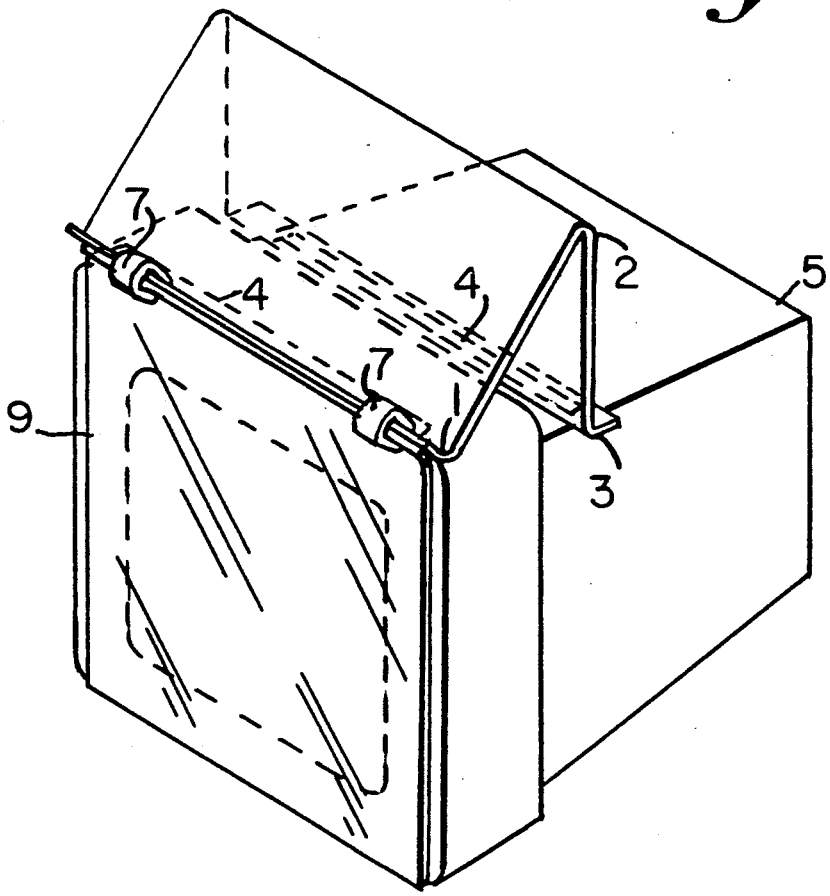
FIG. 8 is a perspective view of the support and glare screen shown in FIG. 7.

FIGS. 7 and 8 show another accessory which can be attached to the support shown in FIGS. 1 and 2. A glare shield 9 may be attached to the support by the same R-shaped type metal clamps 7 as are used for attaching a visor shield. The glare shield is provided with a curved upper lip in the same fashion that the visor shield, so that the metal clamp securely holds the glare screen to the support in a position directly in front of the display screen.

Figure 12:
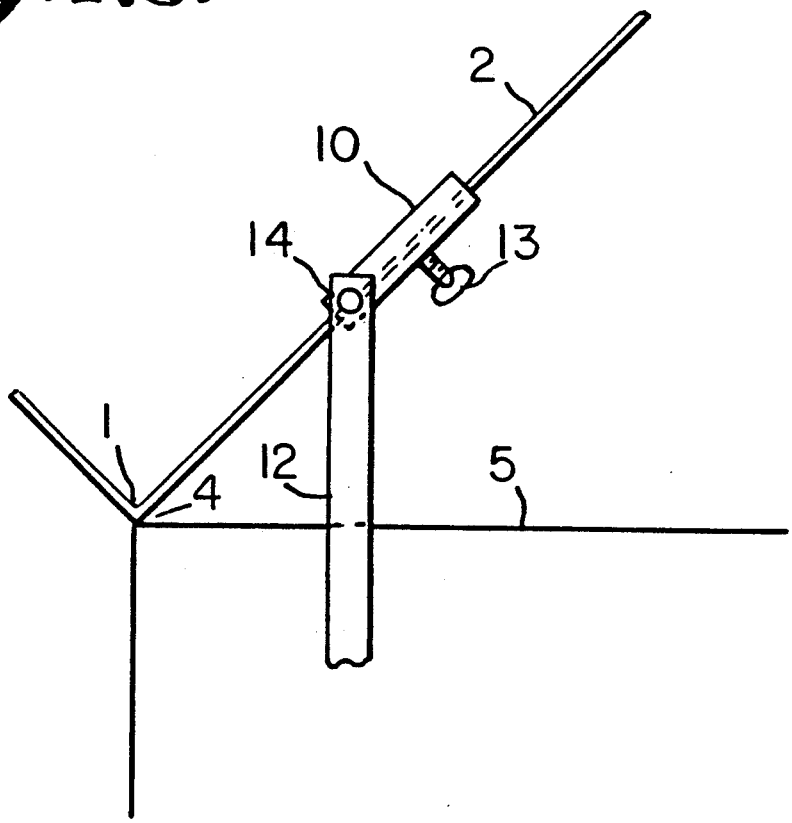
FIG. 12 is an enlarged detail of a preferred clamp mechanism for attaching an accessory to a support.

FIGS. 9 and 10 show an accessory attachment which attaches to the side of the support. A clamp 10 is provided, which holds the accessory mounting bracket to the support. An accessory mounting arm 12 is pivotally attached to clamp 10 at point 14 shown in FIG. 12. An accessory is secured to the opposite end of mounting arm 12. The accessory shown in FIGS. 9 and 10 is a storage box for various utensils common to a work station. Alternatively, a wide variety of other accessories may be attached to the support by the same or similar mounting means. These accessories include headsets, clipboards, speakers, phones, remote control, Rolodex, dictating machines, coffee mugs, power strips, and many others. FIG. 12 is an enlarged view of the attachment means for holding such an accessory mount to the support.

FIG. 11 is an enlarged detail showing the metal clip 7 used to hingedly attach a visor 8 (or glare screen) to the support. This arrangement allows the visor 8 to be held in an infinite number of angles with respect to the support.

The rigid sheet material which may be used for the supports according to the present invention include, but are not limited to, sheet metals and plastics. In particular, acrylic sheets are easy to bend upon heating and form transparent, fashionable and sturdy supports. Thicknesses of the sheet material may vary greatly, depending upon its composition, and can be as thin as 0.125" for i.e., acrylic. A typical starting sheet is cut 12" wide and 13.7" long. All bends are made on the 12" side of the cut sheet. The angles formed between each primary holding surface and its corresponding retaining lip are approximately 90°, but may be anywhere from 70°-110°. The angle at bend 2 between the two holding surfaces may vary greatly, but is preferably between about 40° and about 60°.

Although the present invention has been described in connection with preferred embodiments, it will be appreciated by those skilled in the art that additions, modifications, substitutions and deletions not specifically described may be made without departing from the spirit and scope of the invention defined in the appended claims.

I claim:

1. A support system for supporting a keyboard on top of a display screen device, said support system comprising:

a substantially rectangular sheet of bendable, rigid material having a bend in its middle portion to form a primary holding surface and a secondary holding surface separated by an angle, said angle at a top portion of said support system;

a primary retaining lip formed by a primary retaining lip bend in said primary holding surface which primary retaining lip bend is spaced apart from and parallel to the bend between said primary and secondary holding surfaces;

a secondary retaining lip formed by a secondary retaining lip bend in said secondary holding surface spaced apart from and parallel to the bend between said primary and secondary holding surfaces, outside portions of said primary and secondary retaining lip bends configured so as to enable contact with a non-planar top surface of a display screen device when in use; and an accessory attached to said primary retaining lip, said accessory being substantially planar and having a lip portion, said accessory being attached to said primary retaining lip by an R-shaped clamp, said clamp being of a rigid, slightly bendable material so that the opening in said R-shape narrows to a width which is less than the combined thickness of said primary retaining lip and the lip of said accessory, said R-shaped clamp being deformable to accommodate said primary retaining lip and the retaining lip of said accessory and rigid enough to hold said primary retaining lip and the retaining lip of said accessory together in contact with one another.

2. A support system as in claim 1 further comprising first and second attachment means attached along said outside portions of said primary retaining lip bend and secondary retaining lip bend, respectively.

3. A support system as in claim 2, wherein said attachment means are hook or loop fasteners.

4. A support system as in claim 1, wherein said bend between said primary and secondary holding surfaces is between about 40 degrees and 60 degrees.

5. A support system as in claim 1, wherein said rigid material is acrylic.

6. A support system as in claim 1, wherein said R-shaped clamp is made of metal.

7. A support system as in claim 6, wherein said accessory comprises a screen shield or a visor.

8. A support system as in claim 7, wherein said accessory comprises an acrylic sheet.

9. A support system as in claim 1, further comprising a keyboard resting on one of said holding surfaces.

10. A support system as in claim 1, attached to the top surface of a display screen device, said top surface having a non-planar configuration, and a keyboard resting on one of said holding surfaces of said support system.

11. A support system as in claim 1, wherein attachment means are provided on a bottom portion of said secondary retaining lip and attachment means are provided on a bottom portion of said primary holding surface between the angle between said primary and secondary surfaces and said primary retaining lip.

12. A support system as in claim 1, further comprising an accessory attached to a side portion of said primary holding surface.

13. A support system as in claim 12, wherein said accessory is attached to said primary holding surface by a clamp and bracket linkage.

14. A support system as in claim 7, wherein the retaining lip of accessory comprises a smoothly curved C-shape.

15. A system comprising:

a display screen device having a non-planar top surface and front and rear attachment means mounted on said top surface;

a support for a keyboard, said support comprising a primary holding surface and a secondary holding surface separated by a bend forming an angle, a primary retaining lip formed by a bend in said primary holding surface spaced apart from and parallel to the bend between said primary and secondary surfaces, and a secondary retaining lip formed by a bend in said secondary holding surface spaced apart from and parallel to the bend between the primary and secondary holding surfaces, an attachment means adjacent the primary and secondary retaining lips, said attachment means mating with the front and rear attachment means on the top surface of said display screen device;

a keyboard on said support; and an accessory attached to said primary retaining lip, said accessory being substantially planar and having a lip portion, said accessory being attached to said primary retaining lip by an R-shaped clamp, said clamp being of a rigid, slightly bendable material so that the opening in said R-shape narrows to a width which is less than the combined thickness of said primary retaining lip and the lip of said accessory, said R-shaped clamp being deformable to accommodate said primary retaining lip and the retaining lip of said accessory and rigid enough to hold said primary retaining lip and the retaining lip of said accessory together in contact with one another.

16. A system as in claim 15, wherein a width of said support is substantially equal to a width of said display screen device.

17. A system as in claim 15, wherein said attachment means are substantially the same width as a width of said support.

18. A system as in claim 15, wherein the angle between said primary holding surface and said secondary holding surface is between 40 and 60 degrees.

19. A system as in claim 15, wherein said primary retaining lip and said primary holding surface are separated by an angle of approximately 90 degrees.

* * * * *